US008118281B1

(12) United States Patent
Nolan

(10) Patent No.: US 8,118,281 B1
(45) Date of Patent: Feb. 21, 2012

(54) TIRE LIFTING ASSEMBLY

(76) Inventor: Enos F. Nolan, Allentown, PA (US)

( * ) Notice: Subject to any disclaimer, the term of this patent is extended or adjusted under 35 U.S.C. 154(b) by 368 days.

(21) Appl. No.: 12/392,615

(22) Filed: Feb. 25, 2009

(51) Int. Cl.
*B66F 3/00* (2006.01)

(52) U.S. Cl. ..... 254/131; 254/119; 414/428; 29/273

(58) Field of Classification Search ..... 254/131, 254/120, 114, 119; 280/40.23; 414/428, 414/429, 426; 29/273
See application file for complete search history.

(56) References Cited

U.S. PATENT DOCUMENTS

| | | | | | |
|---|---|---|---|---|---|
| 1,957,126 | A | * | 5/1934 | Appel | 254/131 |
| 2,543,276 | A | * | 2/1951 | Buechler | 414/428 |
| 2,551,483 | A | * | 5/1951 | Bartoe | 414/428 |
| 2,579,853 | A | | 12/1951 | Pardee | |
| 2,640,615 | A | * | 6/1953 | Wedel | 414/428 |
| 2,808,162 | A | | 10/1957 | Hellyer | |
| 3,469,337 | A | | 9/1969 | Reznicek | |
| 4,042,139 | A | * | 8/1977 | Pernsteiner et al. | 414/427 |
| 5,123,470 | A | | 6/1992 | Tran | |
| 5,176,487 | A | * | 1/1993 | Flitton | 414/428 |
| 5,180,141 | A | | 1/1993 | Hunt | |
| 5,181,821 | A | * | 1/1993 | King, Sr. | 414/427 |
| D335,739 | S | * | 5/1993 | Holman et al. | D34/31 |
| 6,056,272 | A | * | 5/2000 | Sayler | 254/131 |
| 6,106,214 | A | * | 8/2000 | Saffelle et al. | 414/427 |
| 6,836,942 | B2 | * | 1/2005 | Oleski | 29/273 |

* cited by examiner

*Primary Examiner* — Lee D Wilson

(57) ABSTRACT

A tire lifting assembly includes a support base with an upper section and a pair of legs attached to and extending downwardly from the upper section. A pole is elongated and has a first end and a second end. A bracket includes a central member and a pair of arms that are attached to opposite ends of the central member. The arms extend in a same direction with respect to each other. The first end of the pole is attached to the central member and is equally spaced from the arms. The pole extends away from the central member in an opposite direction with respect to the arms. A tire support is attached to and extends between the arms. A tire is positionable on the tire support and lifted when the pole is positioned on the base support and the second end of the pole is moved downward.

8 Claims, 5 Drawing Sheets

TIRE LIFTING ASSEMBLY

BACKGROUND OF THE DISCLOSURE

Field of the Disclosure

The disclosure relates to tire lifting devices and more particularly pertains to a new tire lifting device for assisting a person in lifting a tire when a tire is being positioned on or removed from a wheel hub.

SUMMARY OF THE DISCLOSURE

An embodiment of the disclosure meets the needs presented above by generally comprising a support base that includes an upper section and a pair of legs is attached to and extending downwardly from the upper section. A pole is elongated and has a first end and a second end. A bracket includes a central member and a pair of arms that are attached to opposite ends of the central member. The arms extend in a same direction with respect to each other and are orientated perpendicular to the central member. The first end of the pole is attached to the central member and is equally spaced from the arms. The pole extends away from the central member in an opposite direction with respect to the arms. A tire support is attached to and extends between the arms. A tire is positionable on the tire support and lifted when the pole is positioned on the base support and the second end of the pole is moved downward.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
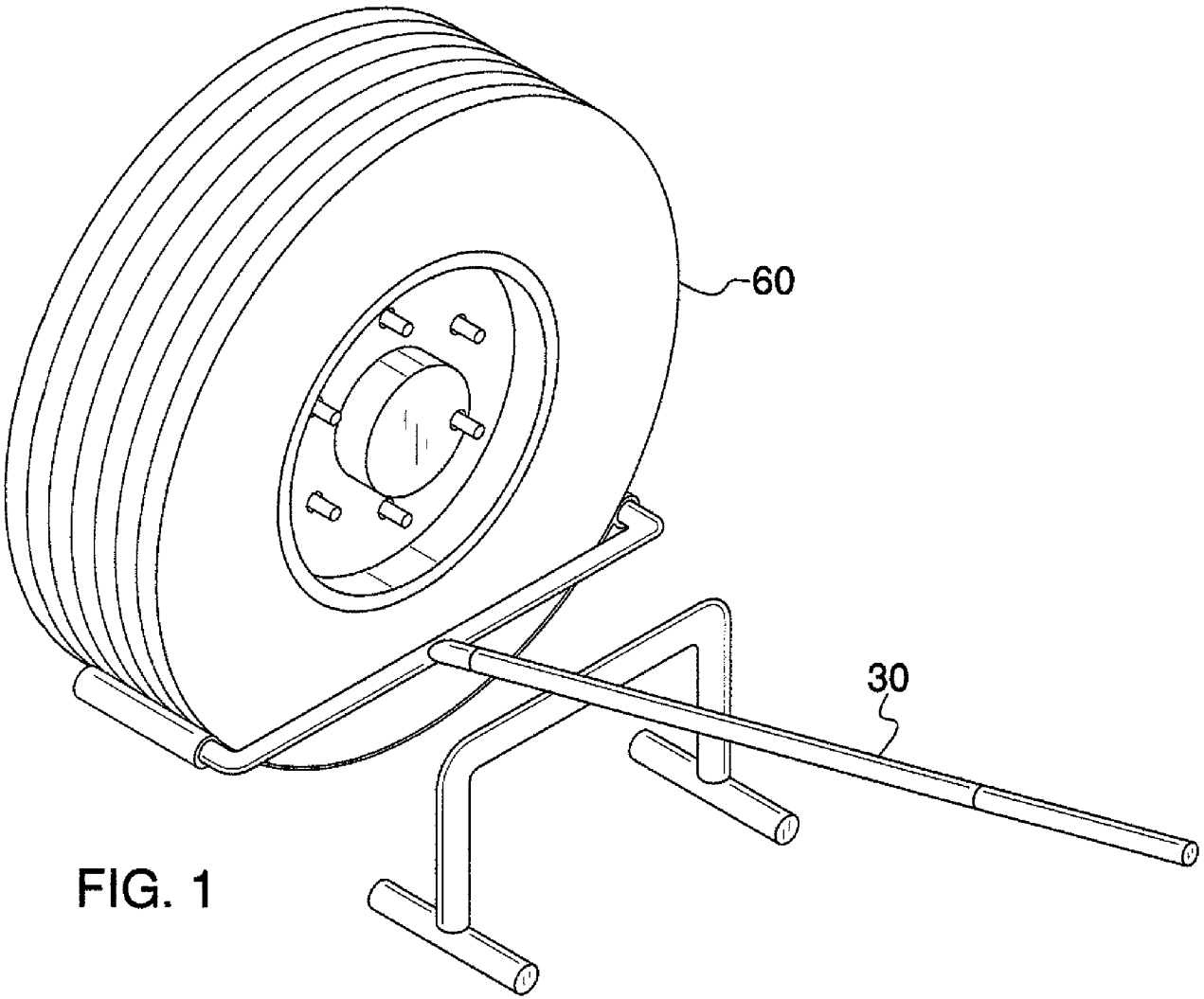
FIG. 1 is a top perspective in-use view of a tire lifting assembly according to an embodiment of the disclosure.
Figure 2:
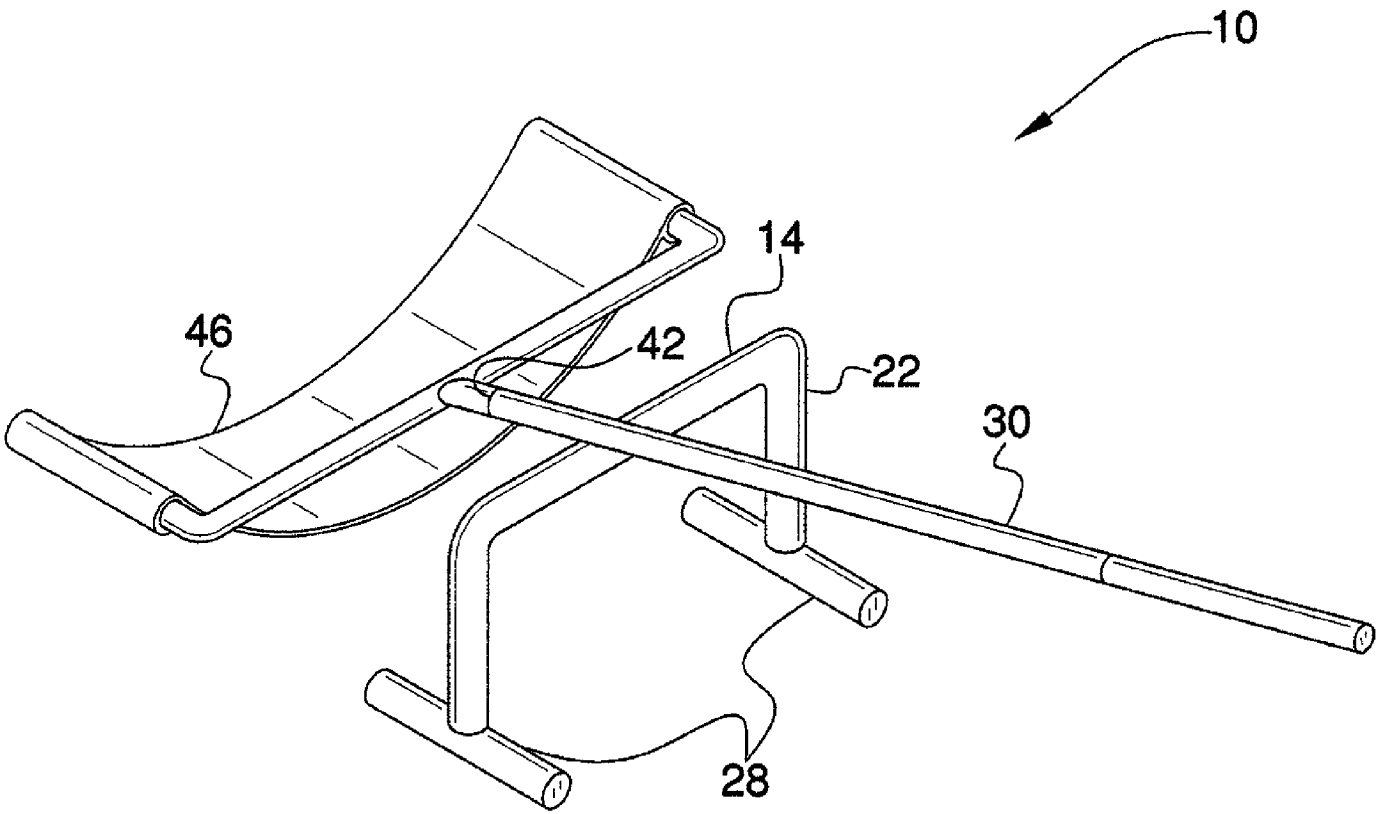
FIG. 2 is a top perspective view of an embodiment of the disclosure.
Figure 3:
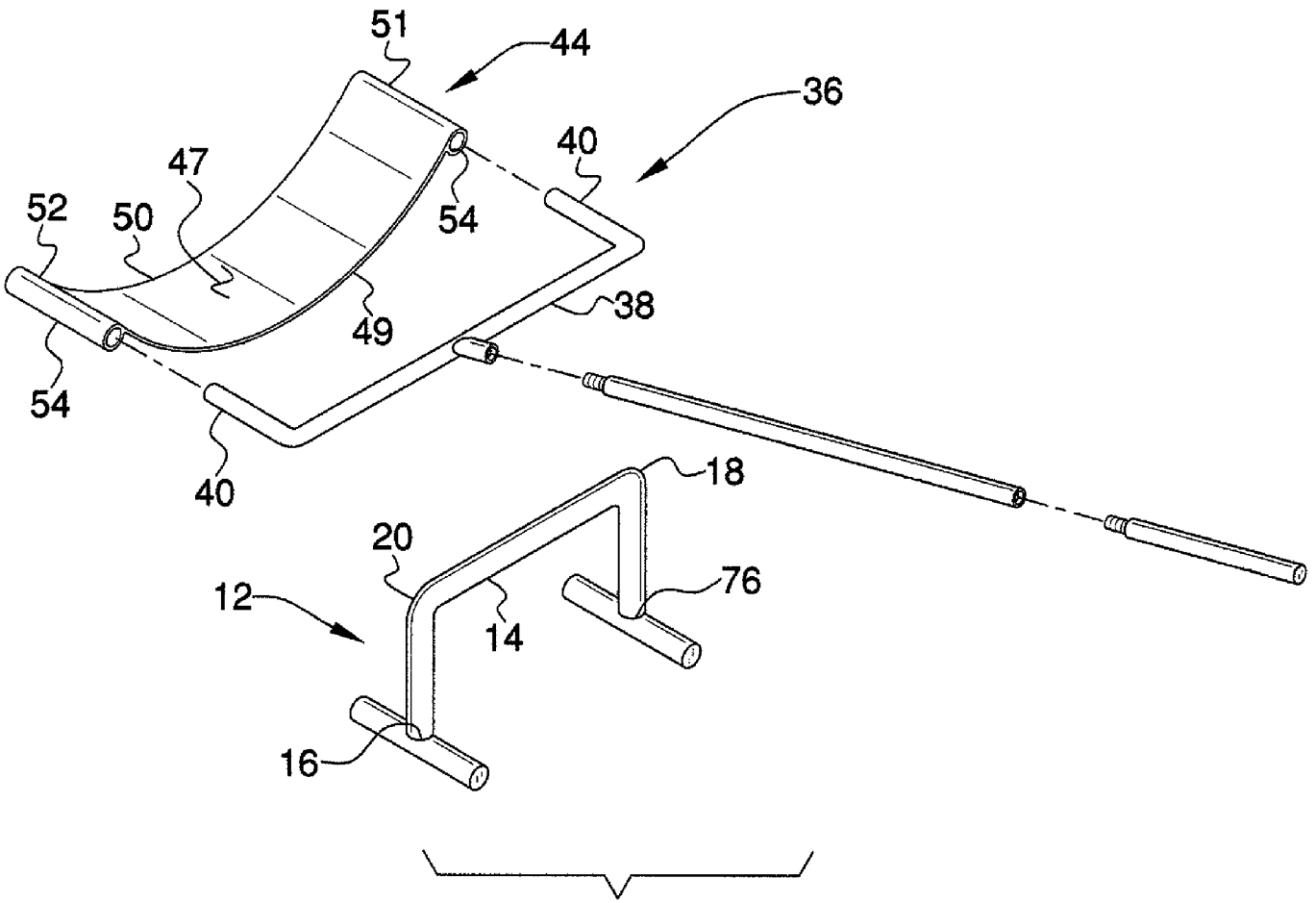
FIG. 3 is a perspective expanded view of an embodiment of the disclosure.

With reference now to the drawings, and in particular to FIGS. 1 through 5 thereof, a new tire lifting device embodying the principles and concepts of an embodiment of the disclosure and generally designated by the reference numeral 10 will be described.

As best illustrated in FIGS. 1 through 5, the tire lifting assembly 10 generally comprises a support base 12 including an upper section 14 and a pair of legs 16 that are attached to and extend downwardly from the upper section 14. The support base 12 has a height between 4 inches and 12 inches. The upper section 14 is elongated and has a first end 18 and a second end 20. Each of the first 18 and second 20 ends of the upper section 14 has one of the legs 16 attached thereto. Each of the legs 16 includes a vertical support 22 having an attached end 24 attached to the upper section 14 and a distal end 26 with respect to the upper section 14. The legs 16 each include a horizontally orientated member 28 attached to an associated distal end 26. The horizontally orientated members 28 are elongated and orientated perpendicular to the upper section. The upper section 14 is cylindrically shaped.

A pole 30 is elongated and has a first end 32 and a second end 34. The pole 30 includes a plurality of sections removably coupled together, such as by threaded couplers, to allow a length of the pole 38 to be selectively altered. The pole 30 has a maximum length greater than 3 feet and may comprise a telescopic pole.

Figure 4:
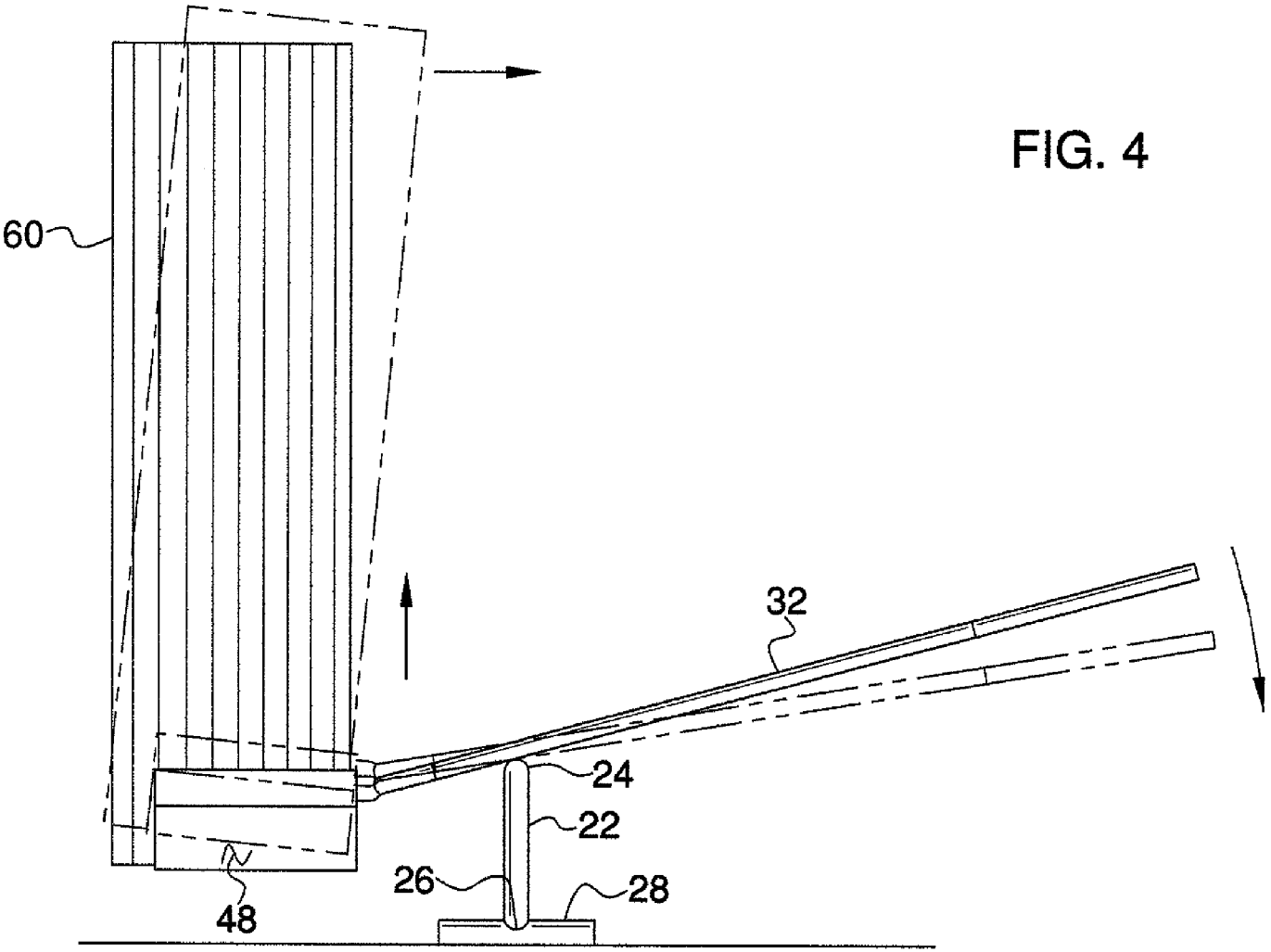
FIG. 4 is a side in-use view of an embodiment of the disclosure.
Figure 5:
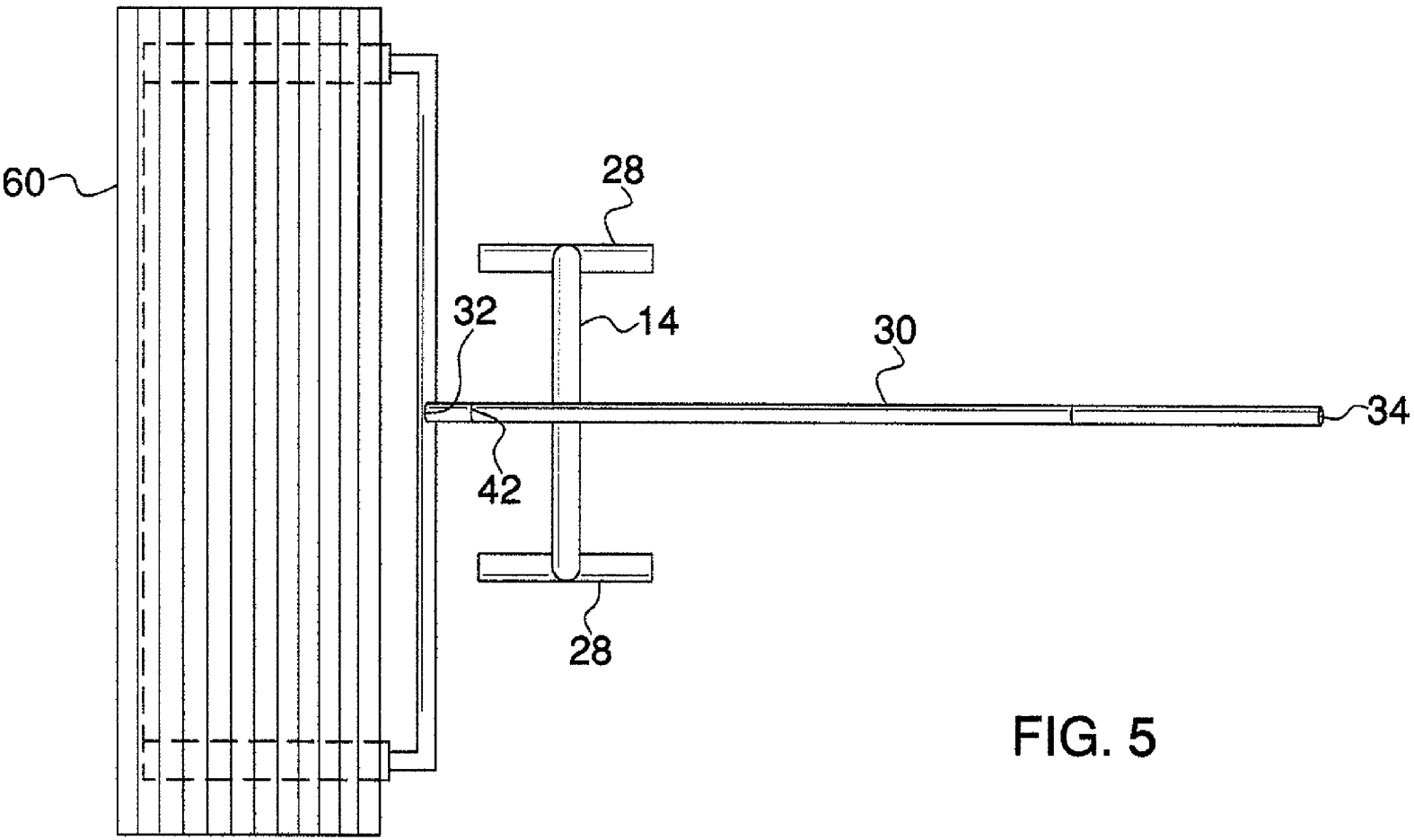
FIG. 5 is a top in-use view of an embodiment of the disclosure.

A bracket 36 includes a central member 38 and a pair of arms 40 that are attached to opposite ends of the central member 38. The arms 40 extend in a same direction with respect to each other and are orientated perpendicular to the central member 38. The first end 32 of the pole 30 is attached to the central member 38 and is equally spaced from the arms 40. The pole 30 may include a break 42 adjacent to the bracket 36 to separate the bracket 36 from a majority of the pole 30 so that only a length of the pole 30 less than 3 inches is attached to the bracket 36. The pole 30 extends away from the central member 38 in a generally opposite direction with respect to the arms 40, though an angle formed between the arms 40 and the pole 30 from a lateral perspective as shown in FIG. 4 may be between 160 degrees and 175 degrees. A distance between the arms 40 is between 9 inches and 24 inches.

A tire support 44 is attached to and extends between the arms 40. A tire 60 is positionable on the tire support and lifted when the pole 30 is positioned on the base support 12 and the second end 34 of the pole 30 is moved downward. The tire support 44 includes a plate 46 that has a top side 47, a bottom side 48, a front edge 49, a rear edge 50, a first lateral edge 51 and a second lateral edge 52. The top side 47 is concavely arcuate from the first lateral edge 51 to the second lateral edge 52. The tire support 44 also include as pair of sleeves 54. Each of the first 51 and second 52 lateral edges has one of the sleeves 54 attached thereto. Each of the arms 40 is removably extendable into one of the sleeves 54 to support the plate 46 between the arms 40.

In use, a user of the assembly 10 assembles together the pole 30, bracket 36 and tire support 44 as described above and as shown in the Figures. The tire support 44 is slid under a tire 60 and the second end 36 of the pole 30 moved downward to lift the tire 60 either for positioning it on a hub or removing it from a hub. The tire 60 may rest against the central member 38 for stabilizing purposes. The pole 30 only rests on, but is not attached to, the upper section 14 so that it can slide to move the tire 60 toward or away from the hub.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A tire lifting assembly comprising:

a support base including an upper section and a pair of legs being attached to and extending downwardly from said upper section;

a pole being elongated and having a first end and a second end;

a bracket including a central member and a pair of arms being attached to opposite ends of said central member, said arms extending in a same direction with respect to each other and being orientated perpendicular to said central member, said first end of said pole being attached to said central member and being equally spaced from said arms, said pole extending away from said central member in an opposite direction with respect to said arms;

a tire support being attached to and extending between said arms, a tire being positionable on said tire support and lifted when said pole is positioned on said base support and said second end of said pole is moved downward, wherein said tire support includes:

a plate having a top side, a bottom side, a front edge, a rear edge, a first lateral edge and a second lateral edge, said top side being concavely arcuate from said first lateral edge to said second lateral edge; and a pair of sleeves, each of said first and second lateral edges having one of said sleeves attached thereto, each of said arms being extendable into one of said sleeves to support said plate between said arms.

2. The assembly according to claim 1, wherein said upper section is elongated and having a first end and a second end, each of said first and second ends of said upper section having one of said legs attached thereto, each of said legs including a vertical support having an attached end attached to said upper section and a distal end with respect to said upper section, each of said legs including a horizontally orientated member attached to an associated distal end, each of said horizontally orientated members being elongated and orientated perpendicular to said upper section.

3. The assembly according to claim 1 wherein said upper section is cylindrically shaped.

4. The assembly according to claim 1, wherein said pole includes a plurality of sections removably coupled together to allow a length of said pole to be selectively altered, said pole having a maximum length greater than 3 feet.

5. The assembly according to claim 1, wherein a distance between said arms is between 9 inches and 24 inches.

6. The assembly according to claim 1 wherein said upper section is cylindrically shaped.

7. The assembly according to claim 1, wherein said pole includes a plurality of sections removably coupled together to allow a length of said pole to be selectively altered, said pole having a maximum length greater than 3 feet.

8. A tire lifting assembly comprising:

a support base including an upper section and a pair of legs being attached to and extending downwardly from said upper section, said support base having a height between 4 inches and 12 inches, said upper section being elongated and having a first end and a second end, each of said first and second ends of said upper section having one of said legs attached thereto, each of said legs including a vertical support having an attached end attached to said upper section and a distal end with respect to said upper section, each of said legs including a horizontally orientated member attached to an associated distal end, each of said horizontally orientated members being elongated and orientated perpendicular to said upper section, said upper section being cylindrically shaped;

a pole being elongated and having a first end and a second end, said pole including a plurality of sections removably coupled together to allow a length of said pole to be selectively altered, said pole having a maximum length greater than 3 feet;

a bracket including a central member and a pair of arms being attached to opposite ends of said central member, said arms extending in a same direction with respect to each other and being orientated perpendicular to said central member, said first end of said pole being attached to said central member and being equally spaced from said arms, said pole extending away from said central member in an opposite direction with respect to said arms, a distance between said arms being between 9 inches and 24 inches;

a tire support being attached to and extending between said arms, a tire being positionable on said tire support and lifted when said pole is positioned on said base support and said second end of said pole is moved downward, said tire support including;

a plate having a top side, a bottom side, a front edge, a rear edge, a first lateral edge and a second lateral edge, said top side being concavely arcuate from said first lateral edge to said second lateral edge; and a pair of sleeves, each of said first and second lateral edges having one of said sleeves attached thereto, each of said arms being extendable into one of said sleeves to support said plate between said arms.

* * * * *